US006589605B2

(12) United States Patent
Shepley et al.

(10) Patent No.: US 6,589,605 B2
(45) Date of Patent: Jul. 8, 2003

(54) MASKING FOR ENGINE BLOCKS FOR THERMALLY SPRAYED COATINGS AND METHOD OF MASKING SAME

(75) Inventors: Barry Edwin Shepley, Novi, MI (US); Keith Raymond Bartle, Sterling Heights, MI (US); Oludele Olusegun Popoola, Novi, MI (US); Patrick John Hilton, Rochester Hills, MI (US); Robert Edward Dejack, Whitmore Lake, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/083,185

(22) Filed: Feb. 26, 2002

(65) Prior Publication Data

US 2002/0078887 A1 Jun. 27, 2002

Related U.S. Application Data

(62) Division of application No. 09/375,223, filed on Aug. 16, 1999, now Pat. No. 6,395,090.

(51) Int. Cl.[7] ..... B05D 1/32; C23C 4/02

(52) U.S. Cl. ..... 427/444; 427/446; 427/448; 427/282; 118/505

(58) Field of Search ..... 427/282, 444, 427/446, 448; 118/504, 505

(56) References Cited

U.S. PATENT DOCUMENTS

| | | | |
|---|---|---|---|
| 3,142,579 | A | 7/1964 | Brooks |
| 4,965,099 | A | 10/1990 | Bornhorst |
| 5,271,967 | A | 12/1993 | Kramer et al. |
| 5,454,505 | A | 10/1995 | Kearns |
| 5,468,295 | A | 11/1995 | Marantz et al. |
| 5,514,422 | A | 5/1996 | McCune |
| 5,573,814 | A | 11/1996 | Donovan |
| 5,580,380 | A | 12/1996 | Liu et al. |
| 5,714,205 | A | 2/1998 | Marantz et al. |
| 5,736,194 | A | 4/1998 | Bedbury et al. |
| 5,766,693 | A | 6/1998 | Rao |
| 5,792,265 | A | 8/1998 | Maier et al. |

FOREIGN PATENT DOCUMENTS

JP 6-65711 * 3/1994

* cited by examiner

*Primary Examiner*—Katherine A. Bareford
(74) *Attorney, Agent, or Firm*—Damian Percari

(57) ABSTRACT

A masking for an engine block to be thermally sprayed with a coating includes a head deck mask portion adapted to engage a head deck of an engine block to prevent over-spray of a thermally sprayed coating on the head deck. The masking also includes a crankcase mask portion adapted to be disposed in a crankcase chamber of the engine block and engage a lower end of a cylinder bore cavity of the engine block to prevent over-spay of the thermally sprayed coating into the crankcase chamber.

14 Claims, 4 Drawing Sheets

MASKING FOR ENGINE BLOCKS FOR THERMALLY SPRAYED COATINGS AND METHOD OF MASKING SAME

CROSS-REFERENCE TO RELATED APPLICATION(S)

This is a divisional of application Ser. No. 09/375,223, filed Aug. 16, 1999, now U.S. Pat. No. 6,395,090.

BACKGROUND OF THE INVENTION

1. Field of the Invention

The present invention relates generally to thermal spraying and, more specifically, to a masking for an engine block for thermally sprayed coatings and a method of masking engine blocks for thermally sprayed coatings.

2. Description of the Related Art

It is known to thermally spray articles. For example, thermal spraying has been used to provide a friction and wear resistance coating on cylinder bores of aluminum engine blocks. During the thermal spraying process, molten metal droplets are formed and sprayed in a relatively wide spray pattern at very high velocities from a spray nozzle of a thermal spray gun. The spray nozzle is stationed relatively close to a surface of the cylinder bore due to a restricted diameter of conventional cylinder bores (typically four to six inches). The combination of such high velocity and short travel distance will allow a small proportion of the particles to bounce or be deflected from the target surface resulting in over-spray. Such over-spray contaminates adjacent surfaces of the engine block not intended to be coated or such over-spray merely falls free of the engine block as waste material. The adjacent surfaces may be the crankcase chamber and support surfaces for the crankshaft. As a result, adequate masking must be provided to protect the crankcase and head deck of the engine block from errant particles that are generated during the thermal spray operation.

Early masking techniques used resilient or abatable plugs to protect apertures or holes of the components that are being thermally sprayed or painted. However, such plugs are not good for components having restricted access to the apertures and are a detriment when the interior of the apertures must not be penetrated or obscured to allow for proper spraying. Gases have also been used as a masking medium. Gases are blown across the interior side of a folded or curled sheet material to mask such side from a molten bath of metal into which the folded sheet is dipped. However, if such technique were to be used with thermal spraying of internal cavities, such gases would interfere with the thermal spray deposition.

Another technique to prevent over-spray is by masking cylinder bore extremities. An example of such masking is disclosed in U.S. Pat. No. 5,573,814 to Donovan. In this patent, a method of masking one or more extremities of a cylinder bore from internal thermal spraying is disclosed. The method includes the steps of supporting one or more inflatable mask members adjacent an end of the cylinder bore and pressurizing the inflatable mask member to expand and annularly engage the end of the cylinder bore. However, none of these techniques can be effectively used in an automated mass production environment practiced in the automotive industry.

Although the above method of masking for thermally sprayed articles has worked, it is desirable to improve the masking of engine blocks for thermally sprayed coatings. It is also desirable to provide a masking that accommodates all possible engine blocks and mask misalignments, provides adequate sealing and protects a crankcase and head deck of an engine block from thermal spray over-spray. It is further desirable to simplify the masking process for an engine block for spraying a thermally sprayed coating. It is still further desirable to provide a masking for an engine block that facilitates easy evacuation of the over-spray material and that is re-usable.

SUMMARY OF THE INVENTION

Accordingly, the present invention is a masking for an engine block to be thermally sprayed with a coating includes a head deck portion adapted to engage a head deck of an engine block to prevent over-spray of a thermally sprayed coating on the head deck. The masking also includes a crankcase portion adapted to be disposed in a crankcase chamber of the engine block and engage a lower end of a cylinder bore cavity of the engine block to prevent over-spray of the thermally sprayed coating into the crankcase chamber.

Also, the present invention is a method of masking an engine block for thermally spraying a coating. The method includes the steps of providing an engine block to be thermally sprayed and providing a head deck masking for masking a head deck of the engine block. The method also includes the steps of providing a crankcase masking for masking a portion of a crankcase chamber of the engine block, disposing the crankcase masking in the crankcase chamber and engaging the crankcase masking with a lower end of a cylinder bore cavity of the engine block. The method further includes the steps of engaging the head deck masking against the head deck of the engine block. The masking prevents over-spray of a coating that is thermally sprayed on a wall of the cylinder bore cavity of the engine block, from adhering to the head deck and entering the crankcase chamber.

One advantage of the present invention is that a masking for and method of masking an engine block for thermally sprayed coatings is provided. Another advantage of the present invention is that the method and masking protect the crankcase from misalignment and over-spray during thermal spraying. Yet another advantage of the present invention is that the method and masking incorporate high temperature rubber with aluminum. Still another advantage of the present invention is that the masking provides adequate stiffness and sealing in selected areas of the engine block, allowing easy evacuation of the over-spray and preventing hot thermal spray particles from adhering to the engine block during coating operation.

Other features and advantages of the present invention will be readily appreciated, as the same becomes better understood, after reading the subsequent description taken in conjunction with the accompanying drawings.

DESCRIPTION OF THE PREFERRED EMBODIMENT(S)

Figure 1:
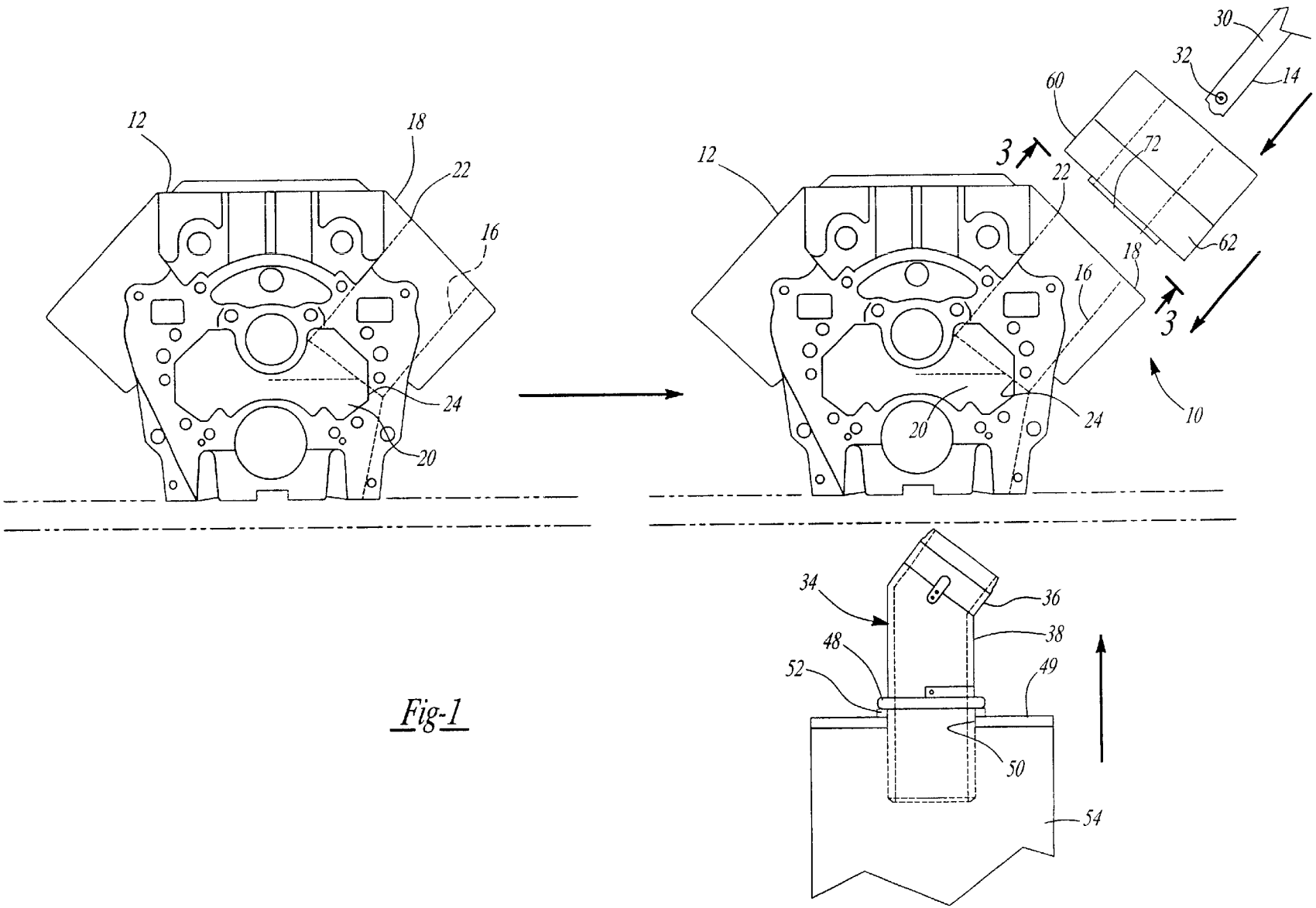
FIG. 1 is an exploded elevational view of a masking, according to the present invention, illustrated in operational relationship with an engine block and thermal spray gun.
Figure 7:
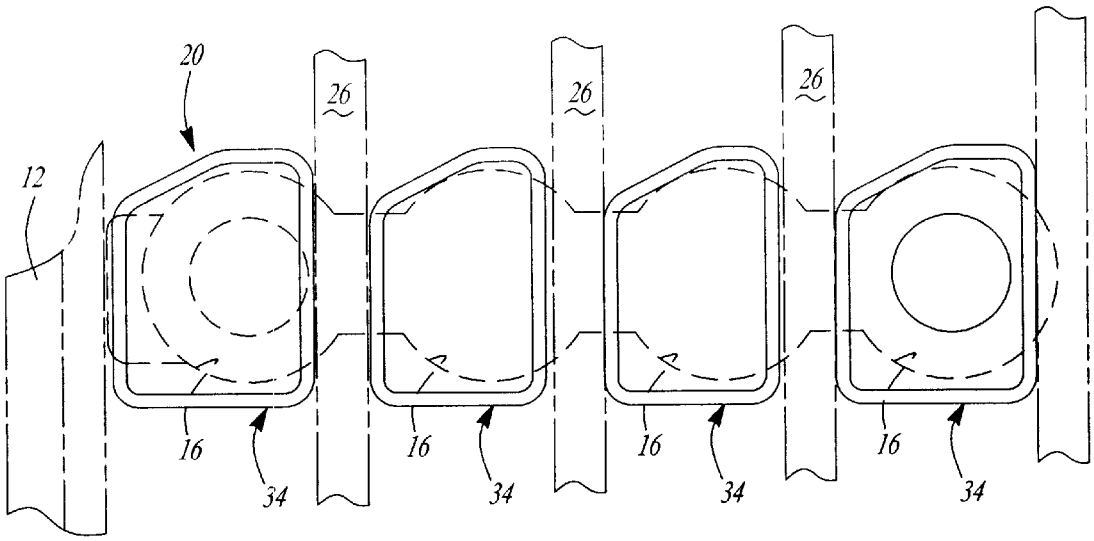
FIG. 7 is a bottom view of the crankcase masking and engine block of FIGS. 5 and 1.

Referring to the drawings and in particular FIG. 1, one embodiment of a masking 10, according to the present invention, is illustrated in operational relationship with an engine block 12 and a thermal spray gun 14. The engine block 12, in this embodiment, is "V" shaped and presents two rows or banks of cylinder bore cavities 16. In this embodiment, the engine block 12 is of a sixty-degree (60°) V8 type and made of an aluminum material. The engine block 12 has a generally flat or planar head deck 18 at a top end of each "V" and a crankcase chamber 20 at a bottom of the "V". Each cylinder bore cavity 16 has one extremity or upper end 22 that opens onto the head deck 12 and another extremity or lower end 24 that opens to the crankcase chamber 20. The engine block 12 may include one or more bulkheads or bearing walls 26 (FIG. 7) longitudinally spaced and extending laterally to interrupt the crankcase chamber 20. It should be appreciated that the engine block 12 may also contain several other complex webs or walls, including walls providing cooling passages about the cylinder bore cavities 16. It should also be appreciated that interference between the bulkhead 26 and cylinder bore cavities 16 eliminate the use of a simple masking scheme. It should further be appreciated that the engine block 12 is conventional and known in the art.

The thermal spray gun 14 is carried on a barrel 30 that has a diameter smaller than a diameter of the cylinder bore cavity 16. The barrel 30 rotates about an axis coincident with the axis of the cylinder bore cavity 16. The thermal spray gun 14 has a spray nozzle 32 that is directed radially across the axis of the cylinder bore cavity 16 and is fed with primary and/or secondary gases from a gas supply line (not shown). It should be appreciated that the thermal spray gun 14 is conventional and known in the art.

Referring to FIGS. 1, 2, 5 and 6, the masking 10, according to the present invention, includes a crankcase mask portion, generally indicated at 34, for masking the lower extremity or end 24 of the cylinder bore cavity 16 to protect the crankcase chamber 20 from over-spray materials. The crankcase mask portion 34 includes a top or engaging portion 36 and a bottom or holding portion 38. The engaging portion 36 has a generally tubular shape with a generally rectangular cross-sectional shape. The engaging portion 36 includes a groove or keyway 40 extending axially along opposed sides for a function to be described. The engaging portion 36 is made of a relatively soft material which is a castable or moldable, chemically stable and elastic polymeric material having a maximum bulk hardness of HB 60, a surface roughness Ra of 1 $\mu$m or less, and can withstand temperatures of up to 600° F. Preferably, the polymeric material for the engaging portion 36 has a composition of 60% poly-dimethysiloxane, 10–30% amorphous silica, 1–5% iron oxide and 1–5% methylsilanetriol triacetate, balance poly-dimethysiloxane.

The holding portion 38 is generally tubular in shape and has a generally rectangular cross-section. The holding portion 38 is made of a metal material such as a cast light metal, preferably aluminum or lightweight steel. The holding portion 38 is internally coated with anti-bond material such as ferro-coating, amorphous carbon, xylene based high heat products, and mold releasing agents. It should be appreciated that the anti-bond material and mold-releasing agents are conventional and known in the art.

The holding portion 38 has a first portion 42 extending axially and a second portion 44 extending at an angle from the first portion 42. In this embodiment, the second portion 44 extends at an angle of approximately 60° from the first portion 42. The second portion 44 has a length less than the first portion 42 and abuts the engaging portion 36. The second portion 44 has a groove or keyway 46 on opposed sides aligned with the keyway 40 on the engaging portion 36 for a function to be described. The first portion 42 has a flange 48 extending outwardly generally perpendicular to the first portion 42 for a function to be described.

The crankcase mask portion 34 may include a metallic holding plate 49 having at least one, preferably a plurality of apertures 50 extending therethrough. The apertures 50 are generally rectangular in shape to receive the first portion 42. The crankcase mask portion 34 may include a rubber gasket seal 52 disposed about each of the apertures 50 of the holding plate 49 to abut the flange 48 of the first portion 42. The holding plate 49 is connected to an exhaust system 54 that allows the evacuation of unwanted over-spray material to be described. It should be appreciated that the exhaust system 54 is conventional and known in the art.

The crankcase mask portion 34 includes a key 56 disposed in the keyway 40 and 46 of the engaging portion 36 and holding portion 38, respectively. The key 56 is generally rectangular in shape and made of a metal material such as aluminum. The key 56 is mechanically fastened to the holding portion 38 and engaging portion 36 by suitable means such as fasteners 58.

Referring to FIGS. 1 through 4, the masking 10 also includes a head deck mask portion, generally indicated at 60, to protect the head deck 18 of the engine block 12 from over-spray materials and facilitates finish machining of the head deck 18. The head deck mask portion 60 has the ability to protect a bore chamfer area or upper end 22 of the cylinder bore cavity 16 and head deck 18 of the engine block 12 in a way that prevents bimetallic cutting during the final machining of the head deck 18. In this embodiment, the head deck mask portion 60 is configured for the engine block 12 having a "V" shape. The head deck mask portion 60 includes a mounting plate 62. The mounting plate 62 is generally rectangular in shape and made of a metal material such as aluminum or steel. The mounting plate 62 has a predetermined thickness such as 1.5 inches. The mounting plate 62 has at least one, preferably a plurality of apertures 64 extending therethrough. The apertures 64 are generally circular in shape and have a predetermined diameter such as 7.38 inches with a one (1) inch wide inside diameter ledge 66. The head deck mask portion 60 also includes a ring 68 fastened to the ledge 66 by suitable means such as fasteners 70. The ring 68 is made of a metal material such as steel. The head deck mask portion 60 further includes an insert 72 to cover the upper end 22 of the cylinder bore cavity 16. The insert 72 is generally circular in shape and has an aperture 74 extending axially therethrough. The aperture 74 is tapered toward a central axis of the insert 72. The insert 72 also has a flange 76 extending radially and a groove 78 disposed beneath the flange 76 to receive the ring 68 to provide adequate sealing between the head deck 18 and the head deck mask portion 60. The insert 72 is made of a relatively soft material, preferably the same material as the engaging portion 36 of the crankcase mask portion 34. It should be appreciated that the insert 72 ensures that no over-spray material touches the head deck 18 surrounding the upper end 22 of the cylinder bore cavity 16 during the thermal spraying operation.

Figure 2:
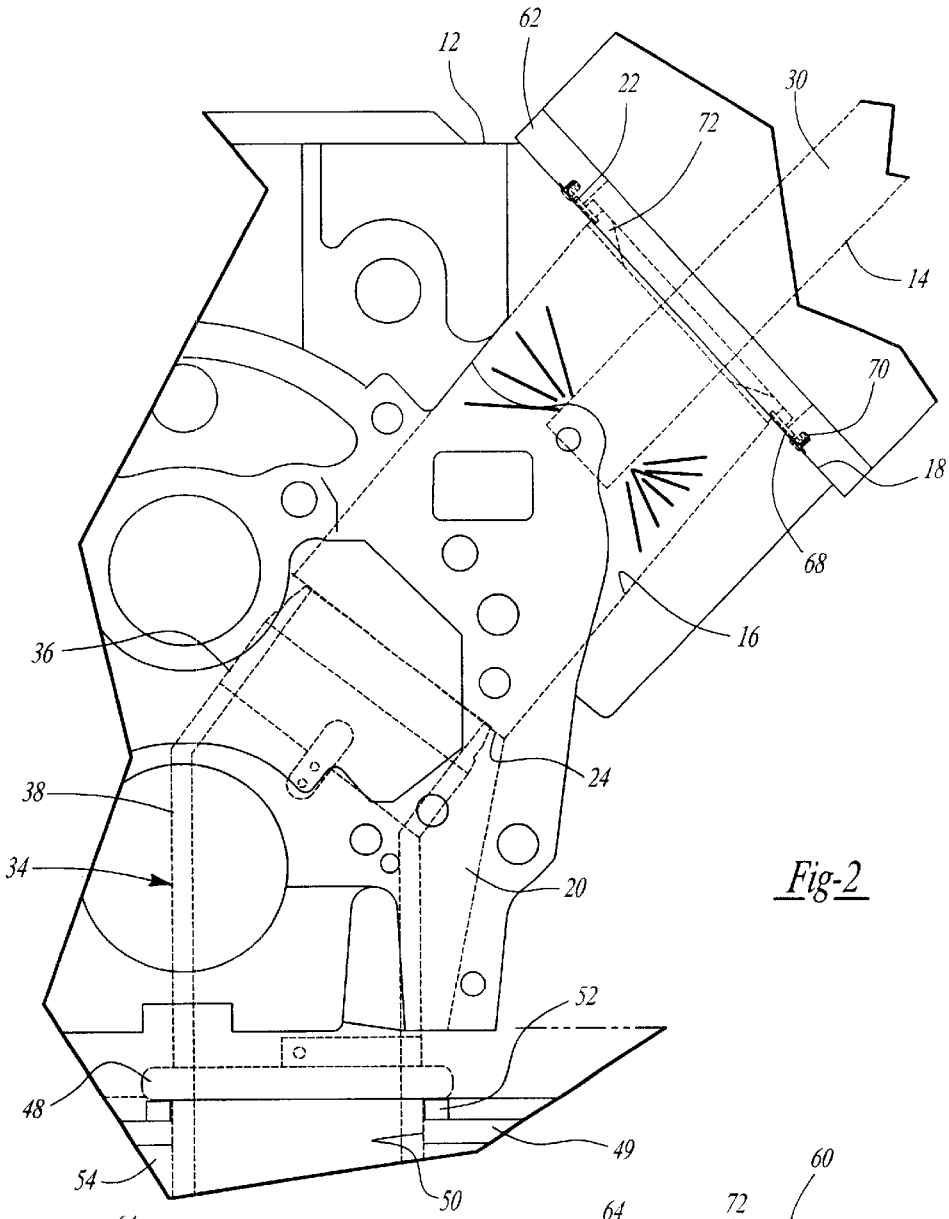
FIG. 2 is a fragmentary elevational view of the masking, engine block, and thermal spray gun of FIG. 1.
Figure 3:
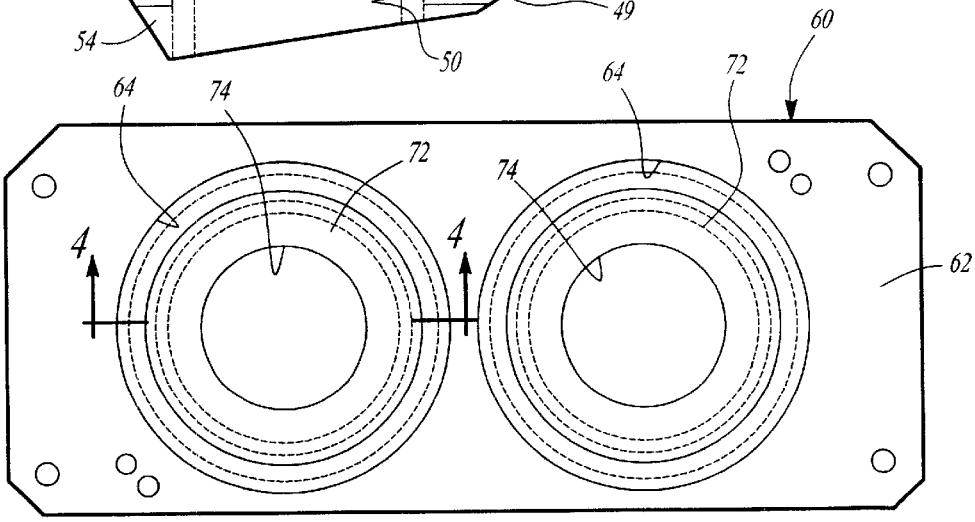
FIG. 3 is a view taken along line 3—3 of FIG.
Figure 4:
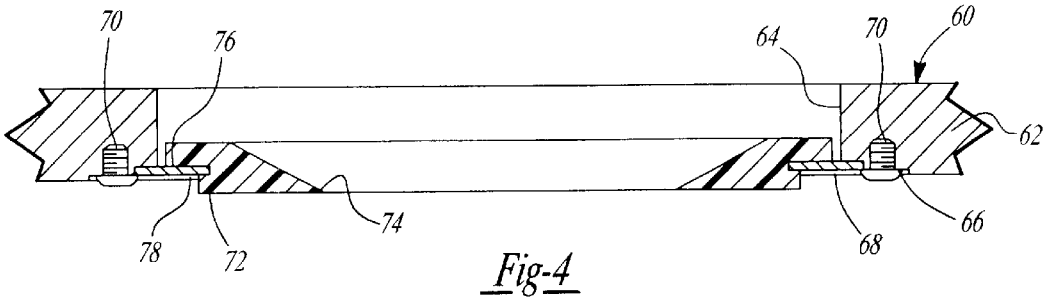
FIG. 4 is a sectional view taken along line 4—4 of FIG. 3.
Figure 5:
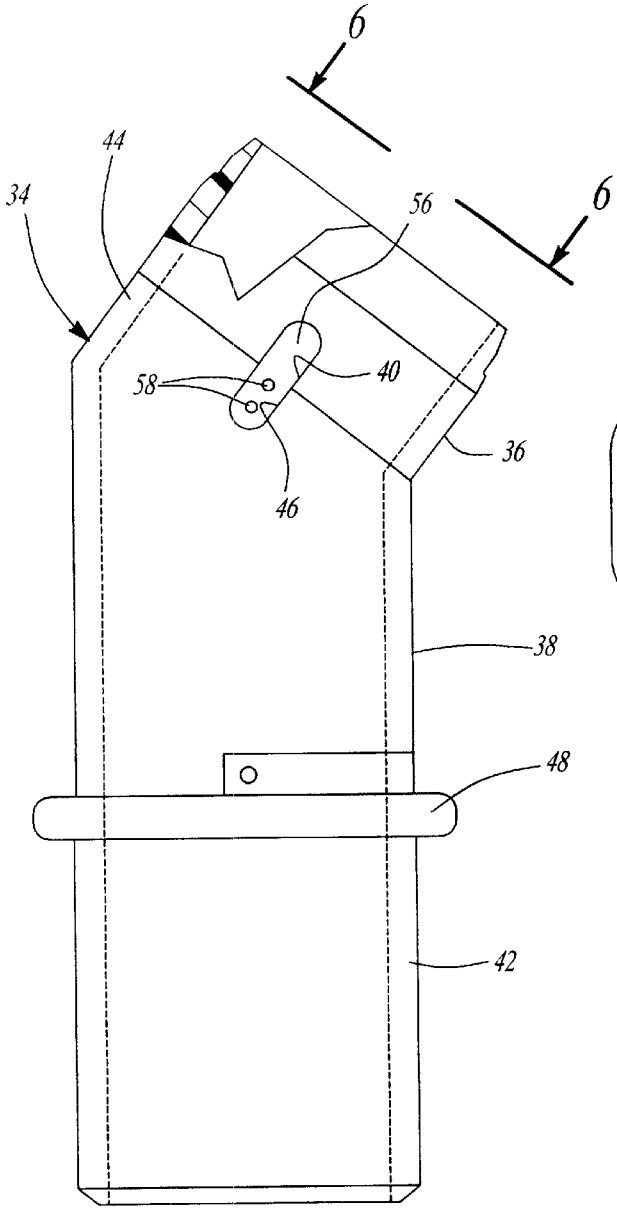
FIG. 5 is an elevational view of a crankcase masking portion of the masking of FIG. 1.
Figure 6:
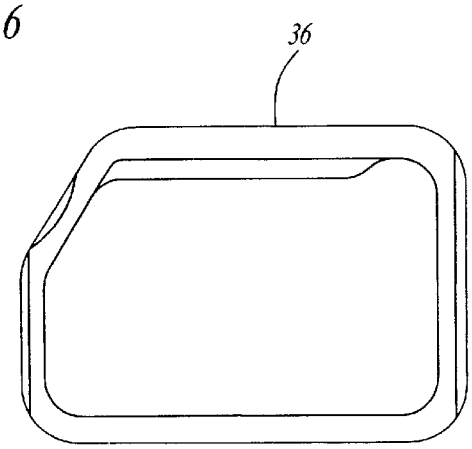
FIG. 6 is a view taken along line 6—6 of FIG. 5.

Referring to FIGS. 1 and 2, in operation, the engine block 12 is transferred into a thermal spray booth and is set on locating pins (not shown). The crankcase mask portion 34 slides up into the crankcase chamber 20 and puts the engaging portion 32 in compression to seal the lower end 24 of the cylinder bore cavity 16 of the engine block 12 prior to the onset of the thermal spraying operation. In the embodiment illustrated, four crankcase mask portions 34 are used for one row of cylinder bore cavities 16 of the V8 type engine block 12. The head deck mask portion 60 is removable fastened by suitable means such as clamps (not shown) to a portion of the thermal spray gun 14. The thermal spray gun 14 moves toward the head deck 18 of the engine block 12 and puts the insert 72 in compression to seal the head deck 18 of the engine block 12 prior to the onset of the thermal spraying operation. The spray nozzle 32 and a portion of the barrel 30 slide through the aperture 74 of the insert 72 in the cylinder bore cavity 16 and rotate to thermally spray a metal material to a predetermined thickness. Metal materials usable for thermal spraying include metals such as aluminum and high temperature high strength carbon steel. The spray nozzle 32 and barrel 30 move axially back and forth in passes, preferably fifteen (15), to deposit the metal material to the predetermined thickness as is known in the art. The exhaust system 54 withdraws over-spray particles of the metal material.

At the end of thermal spraying operation for one cylinder bore cavity 16, the spray nozzle 32 and barrel 30 of the thermal spray gun 14 are slid from the cylinder bore cavity 16 and moved laterally to thermal spray the adjacent cylinder bore cavity 16. Once two cylinder bore cavities 16 are thermally sprayed, the head deck mask portion 60 disengages the head deck 18 of the engine block 12. The head deck mask portion 60 is moved laterally by the thermal spray gun 14 to thermal spray the next two adjacent cylinder bore cavities 16. Once these cylinder bore cavities 16 are thermally sprayed, the head deck mask portion 60 disengages the head deck 18 of the engine block 12. The crankcase mask portion 34 slides back, allowing the engaging portion 36 to spring back to its original shape. All partially bonded over-spray particles are debonded during the spring back, thereby cleaning the engaging portion 32. This ability to self-clean assures multiple reuse of the masking 10. As a result, the masking 10 can be reused more than four to twenty times without changing as compared to conventional masks.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of masking an engine block to be thermally sprayed with a coating, said method comprising the steps of:

providing a head deck mask portion and engaging the head deck mask portion with a head deck of an engine block to prevent over-spray of a thermally sprayed coating on the head deck; and providing a non-inflatable crankcase mask portion having an engaging portion being made of an elastic polymeric material and disposing the engaging portion of the crankcase mask portion in a crankcase chamber of the engine block and engaging the engaging portion with a lower end of a cylinder bore cavity of the engine block to prevent over-spray of the thermally sprayed coating into the crankcase chamber.

2. A method as set forth in claim 1 wherein said step of providing the crankcase mask portion includes providing a holding portion connected to the engaging portion.

3. A method as set forth in claim 2 wherein said step of providing the engaging portion includes providing a generally tubular and generally rectangular cross-section.

4. A method as set forth in claim 2 wherein said step of providing the holding portion includes providing a generally tubular and rectangular cross-section.

5. A method as set forth in claim 1 wherein said step of providing a head deck mask portion includes providing a mounting plate having at least one aperture extending therethrough.

6. A method of masking an engine block to be thermally sprayed with a coating, said method comprising the steps of:

providing a head deck mask portion and engaging the head deck mask portion with a head deck of an engine block to prevent over-spray of a thermally sprayed coating on the head deck;

providing a crankcase mask portion having an engaging portion to engage a lower end of a cylinder bore cavity of the engine block and a holding portion connected to the engaging portion and disposing the crankcase mask portion in a crankcase chamber of the engine block and engaging the lower end of the cylinder bore cavity of the engine block to prevent over-spray of the thermally sprayed coating into the crankcase chamber; and wherein the holding portion includes a first portion extending axially and a second portion extending at an angle to the first portion, the second portion abutting the engaging portion.

7. A method as set forth in claim 6 including the step of providing a holding plate having at least one aperture extending therethrough to engage an exhaust system, the first portion being disposed in the at least one aperture.

8. A method of masking an engine block to be thermally sprayed with a coating, said method comprising the steps of:

providing a head deck mask portion and engaging the head deck mask portion with a head deck of an engine block to prevent over-spray of a thermally sprayed coating on the head deck;

providing a non-inflatable crankcase mask portion and disposing the crankcase mask portion in a crankcase chamber of the engine block and engaging a lower end of a cylinder bore cavity of the engine block to prevent over-spray of the thermally sprayed coating into the crankcase chamber; and wherein said step of providing a head deck mask portion includes providing a mounting plate having at least one aperture extending therethrough, providing an insert, and disposing the insert in the at least one aperture.

9. A method of masking an engine block to be thermally sprayed with a coating, said method comprising the steps of:

providing a head deck mask portion including a mounting plate having at least one aperture extending therethrough, providing an insert, and disposing the insert in the at least one aperture and engaging the head deck mask portion with a head deck of an engine block to prevent over-spray of a thermally sprayed coating on the head deck;

providing a crankcase mask portion and disposing the crankcase mask portion in a crankcase chamber of the engine block and engaging a lower end of a cylinder bore cavity of the engine block to prevent over-spray of the thermally sprayed coating into the crankcase chamber; and wherein said step of providing the head deck mask portion includes providing a ring and disposing the ring in the at least one aperture and connecting the mounting plate to carry the insert.

10. A method of masking a head deck of an engine block to be thermally sprayed with a coating, said method comprising the steps of:

providing a plate and engaging the plate with a head deck of an engine block to prevent over spray of a thermally sprayed coating on the head deck, the plate including at least one aperture extending therethrough; and providing an insert and disposing the insert in the at least one aperture and having an aperture extending therethrough.

11. A method of masking a head deck of an engine block to be thermally sprayed with a coating, said method comprising the steps of:

providing a plate and engaging the plate with a head deck of an engine block to prevent over spray of a thermally sprayed coating on the head deck, the plate including at least one aperture extending therethrough;

providing an insert and disposing the insert in the at least one aperture and having an aperture extending therethrough; and providing a ring and disposing the ring in the at least one aperture and engaging the plate to carrying the insert.

12. A method of masking a crankcase chamber of an engine block to be thermally sprayed with a coating, said method comprising the steps of:

providing a non-inflatable engaging portion being made of an elastic polymeric material and disposing the engaging portion in a crankcase chamber of an engine block and engaging a lower end of a cylinder bore cavity of the engine block to prevent over-spay of the thermally sprayed coating into the crankcase chamber; and providing a holding portion connected to the engaging portion to hold the engaging portion in compression with the engine block.

13. A method of masking a crankcase chamber of an engine block to be thermally sprayed with a coating, said method comprising the steps of:

providing an engaging portion and disposing the engaging portion in a crankcase chamber of an engine block and engaging a lower end of a cylinder bore cavity of the engine block to prevent over-spay of the thermally sprayed coating into the crankcase chamber;

providing a holding portion connected to the engaging portion to hold the engaging portion in compression with the engine block; and wherein the holding portion includes a first portion extending axially and a second portion extending at an angle to the first portion, the engaging portion being connected to the second portion.

14. A method of masking an engine block for thermally spraying a coating, said method comprising the steps of:

providing an engine block to be thermally sprayed;

providing a head deck masking for masking a head deck of the engine block;

providing a non-inflatable crankcase masking having a portion being made of an elastic polymeric material for masking a portion of a crankcase chamber of the engine block;

disposing the crankcase masking in the crankcase and engaging the crankcase masking with a lower end of a cylinder bore cavity of the engine block; and engaging the head deck masking against the head deck of the engine block, wherein the masking prevents over-spray of a coating, that is thermally sprayed on a wall of the cylinder bore cavity of the engine block, from adhering to the head deck and entering the crankcase chamber.

* * * * *